US005839170A

United States Patent [19]

Cho

[11] Patent Number: 5,839,170

[45] Date of Patent: Nov. 24, 1998

[54] BELT BUCKLE

[76] Inventor: Hua-Jen Cho, No. 6 Alley 6, Lane 313, Chang-Ane St., Lu-Chou City, Taipei Hsien, Taiwan

[21] Appl. No.: 992,455

[22] Filed: Dec. 17, 1997

[51] Int. Cl.[6] ..... A44B 11/02

[52] U.S. Cl. ..... 24/163 R

[58] Field of Search ..... 24/163 R, 19, 24/269, 68 SK, 68 R, 68 E

[56] References Cited

U.S. PATENT DOCUMENTS

| | | | |
|---|---|---|---|
| 5,357,690 | 10/1994 | Ho | 24/68 SK |
| 5,661,876 | 9/1997 | Goldenberg | 24/19 |
| 5,745,963 | 5/1998 | Graziano | 24/68 SK |

*Primary Examiner*—James R. Brittain
*Attorney, Agent, or Firm*—Dougherty & Troxell

[57] ABSTRACT

Disclosed is a belt buckle including a main body having a belt end fixing means for firmly holding an end of a belt, a passage for another end of the belt to thread through, and a chamber formed behind the passage for receiving a ratchet wheel, a brake member, a push plate, a push button, and springs therein. The chamber is openably closed with a back cover. The ratchet wheel has teeth projected into the passage to press against and rotate in the same direction as the moving belt. One of the springs is positioned behind the brake member to press the latter against the ratchet wheel, so that the ratchet wheel can only rotate in one direction and therefore stops the belt from moving backward. The push button can be depressed to push the push plate backward and therefore causes the brake member to disengage from the ratchet wheel, allowing the ratchet wheel to rotate in a reverse direction to loosen the belt. With these arrangements, the belt can be finely adjusted in length as desired and be held at the desired length in a more reliable manner.

8 Claims, 4 Drawing Sheets

BELT BUCKLE

BACKGROUND OF THE INVENTION

The present invention relates to a belt buckle, and more particularly to a belt buckle which has special but simple structure to allow fine adjustment of the belt length.

A belt buckle is used to adjust the length of a belt, so that the belt can fitly fasten around a user's waist.

A commercially available belt buckle usually includes a frame and a spike. The spike goes through one of the holes preformed on a belt which is threaded through the buckle frame, so that the belt is adjusted and fixed to a desired circumferential length close to the user's waistline. The holes preformed on the belt are usually equally spaced. When the user adjusts the belt via the buckle, the interval between two holes on the belt is not always the same as a length needed by the user in adjusting the belt. That is, the belt might be a bit too tight or too loose around the user's waist even though it has been adjusted via the conventional buckle.

SUMMARY OF THE INVENTION

It is therefore a primary object of the present invention to provide a belt buckle which includes a main body having a belt end fixing means for firmly holding an end of a belt, a passage formed behind a front surface of the main body for another end of the belt to thread through, and a chamber formed behind the passage for receiving a ratchet wheel, a brake member, a push plate for controlling the brake member, a push button for controlling the push plate, and springs. The chamber is openably closed with a back cover. The ratchet wheel has teeth projected into the passage to press against and rotate in one direction with the belt passing through the passage. One of the springs is positioned behind the brake member to press the latter against the ratchet wheel, so that the ratchet wheel can only rotate in one direction and therefore stops the belt from moving backward. The push button can be depressed to push the push plate backward and therefore causes the brake member to disengage from the ratchet wheel, allowing the ratchet wheel to rotate in two directions. With these arrangements, the belt can be finely adjusted in length as desired and be held at the desired length in a more reliable manner.

BRIEF DESCRIPTION OF THE DRAWINGS

The above and other objects as well as the structure of the present invention can be best understood by referring to the following detailed description of the preferred embodiment and the accompanying drawings, wherein.

DETAILED DESCRIPTION OF THE PREFERRED EMBODIMENT

Figure 1:
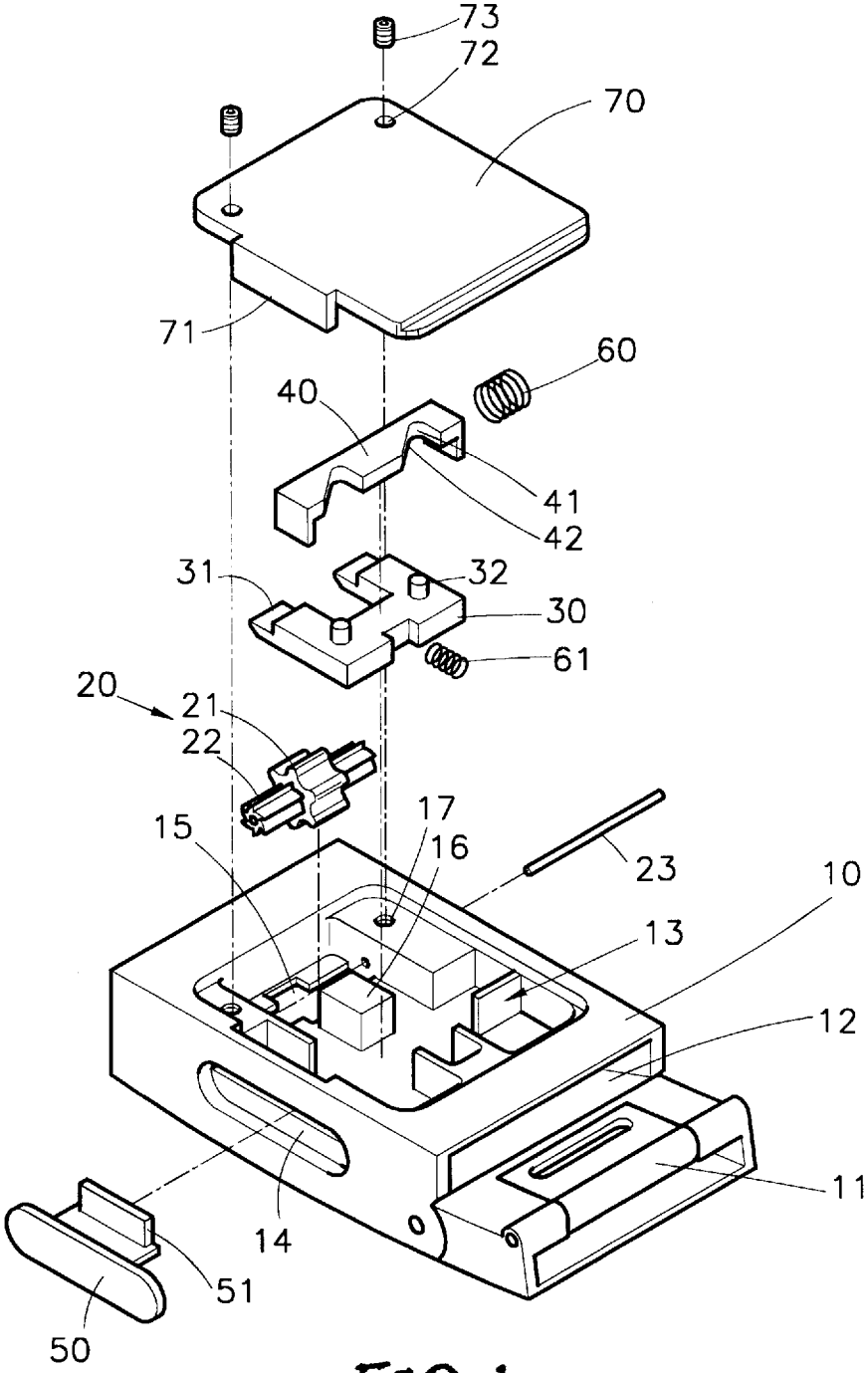
FIG. 1 is an exploded perspective of a belt buckle according to the present invention viewing from a backside thereof.
Figure 2:
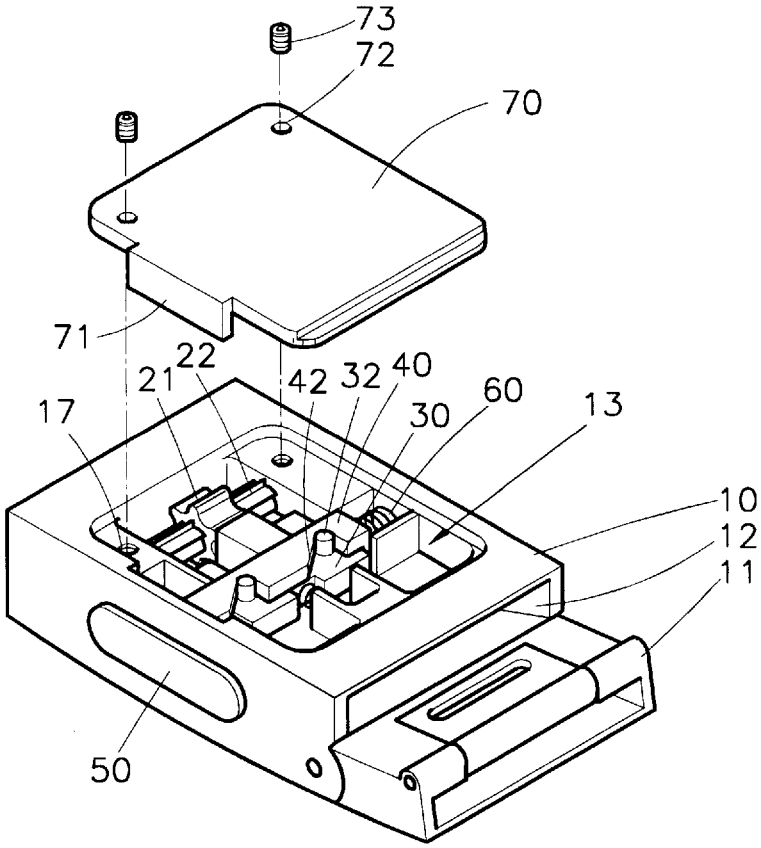
FIG. 2 is an assembled perspective of the buckle of FIG. 1, still viewing from a backside thereof, wherein a back cover of the buckle has not been closed to the buckle yet.

Please refer to FIGS. 1 and 2, the present invention relates to a belt buckle which mainly includes a main body 10, a ratchet wheel 20, a brake member 30, a push plate 40, a push button 50, springs 60 and 61, and a back cover 70.

The main body 10 has a belt end fixing means 11 connected to a first end thereof for firmly holding an end of a belt 80 thereto. A passage 12 is formed behind a front surface of the main body 10 and extends a full length of the main body 10 for another end of the belt 80 to thread therethrough. A chamber 13 with a backward opening is formed on the main body 10 behind the passage 12 and is separated from the passage 12 by a partition. The chamber 13 is provided at one side wall (which is a top wall of the main body 10 in FIG. 1) with a slot 14 for mounting the push button 50 thereinto. A through hole 15 is provided on the partition near a second end of the main body 10 opposite to the belt end fixing means 11. A block 16 is provided in the chamber 13 to project backward from the partition. And, threaded holes 17 are provided at two corners of the chamber 13.

The ratchet wheel 20 includes a plurality of pressing teeth 21 formed around a middle portion thereof and a plurality of stop teeth 22 provided around the ratchet wheel 20 at two sides of the pressing teeth 21. The ratchet wheel 20 is rotatably mounted in the chamber 13 just behind the through hole 15 by extending two ends of a shaft 23 of the ratchet wheel 20 into two side walls (that is, the top and the bottom wall) of the chamber 13, such that the pressing teeth 21 of the ratchet wheel 20 project through the hole 15 and into the passage 12.

The brake member 30 is mounted in the chamber 13 and has two forward extended pawls 31 formed at an end thereof to correspond to the stop teeth 22 at two sides of the ratchet wheel 20. There is at least one rod 32 projecting from a side surface of the brake member 30 facing the backward opening of the chamber 13. The block 16 in the chamber 13 extends through and between the two pawls 31, such that the brake member 30 may slide forward and backward relative to the block 16. A spring 61 is positioned between another end of the brake member 30 opposite to the pawls 31 and an end wall of the chamber 13 opposite to the through hole 15, so that the brake member 30 is normally pushed forward to engage its two pawls 31 with the stop teeth 22 of the ratchet wheel 20, limiting the ratchet wheel 20 to turn in only one direction.

The push plate 40 is so mounted that it traverses the side surface of the brake member 30 having the at least one projected rod 32 thereon. A spring 60 is positioned between the push plate 40 and the bottom wall of the chamber 13 opposite to the slot 14, so that the push plate 40 is normally pushed to press against the push button 50 which is mounted in the slot 14. At least one locating recess 41 is formed on the push plate 40 corresponding to the at least projected rod 32 on the brake member 30. One side of the at least locating recess 41 forms an outward inclined guiding surface 42. When the push plate 40 is caused to move against the spring 60, the guiding surface 42 shall cause the brake member 30 to move backward relative to the block 16, making the pawls 31 disengaged from the stop teeth 22 of the ratchet wheel 20.

The push button 50 is mounted in the slot 14 on the main body 10 and has a stop plate 51 connected to a bottom edge thereof. The stop plate 51 is normally in contact with one end of the push plate 40 opposite to the spring 60, such that when the push button 50 is pushed toward the main body 10, the stop plate 51 shall push the push plate 40 to move against the spring 60.

The back cover 70 is removably covered on the backward opening of the chamber 13 and has an inward extended stop plate 71 provided at an edge thereof corresponding to the stop plate 51 on the push button 50, such that when the cover 70 closes the chamber 13, the stop plate 71 shall locate between the stop plate 51 and the top wall of the chamber 13 to prevent the push button 50 from separating from the main body 10. The cover 70 is provided with screw holes 72 corresponding to the threaded holes 17 formed in the chamber 13, so that screws 73 may be screwed into the holes 72 and 17 to tighten the cover 70 against the main body 10.

Figure 3:
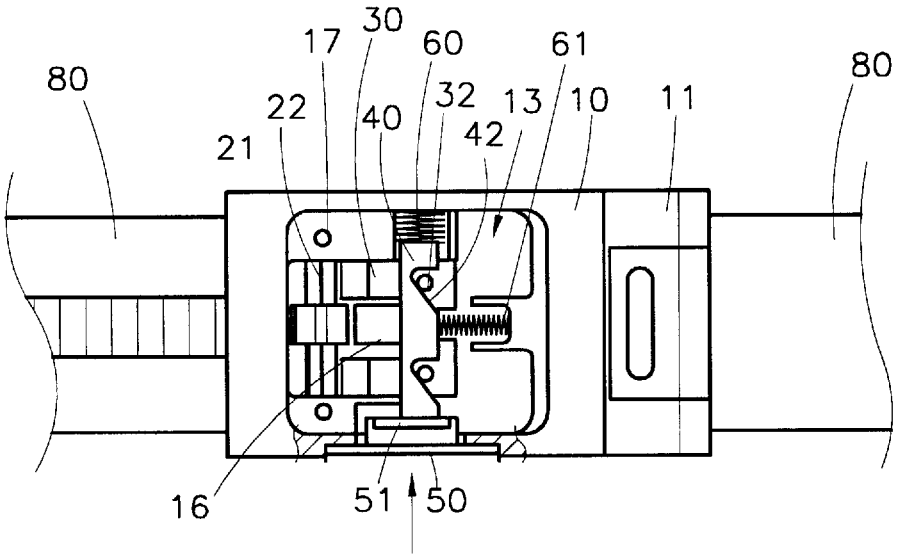
FIG. 3 is a bottom view of the belt buckle of FIG. 1 with a belt fixedly held in the buckle.
Figure 4:
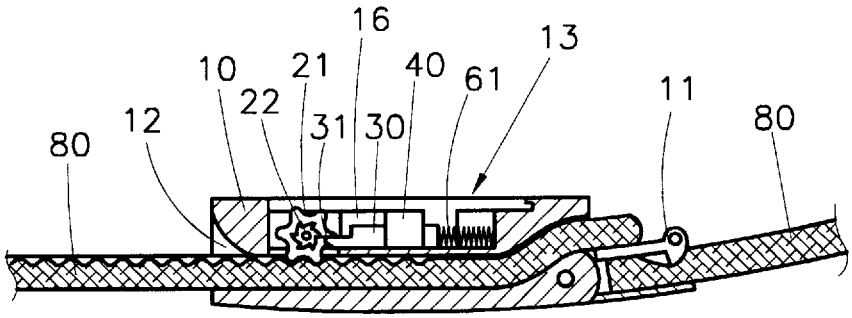
FIG. 4 is a side sectional view of the buckle of FIG. 3.

Please now refer to FIGS. 3 and 4. To use the buckle of the present invention to adjust the length of the belt 80, first firmly hold an end of the belt 80 with the belt end fixing means 11, and then insert another end of the belt 80 into the passage 12 from an end of the passage 12 opposite to the belt end fixing means 11. Push the belt 80 forward so that it passes the ratchet wheel 20, causing the ratchet wheel 20 to rotate with the moving belt 80. Due to the spring 61 which pushes against the pawls 31 of the brake member 30 against the stop teeth 22 of the ratchet wheel 20, the ratchet wheel 20 can only rotate in one direction and presses the pressing teeth 21 against the belt 80, preventing the belt 80 from moving backward. By this way, the belt 80 can be adjusted to any desired length.

Figure 5:
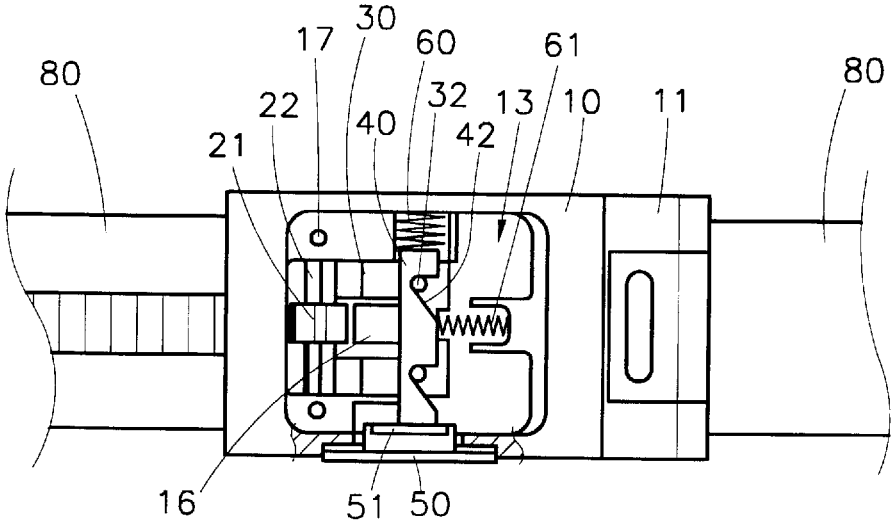
FIG. 5 is a bottom view similar to FIG. 3 but with a push button of the buckle depressed to loosen the buckle.
Figure 6:
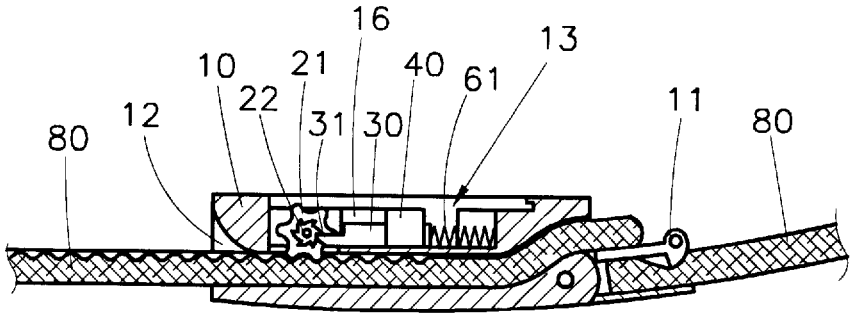
FIG. 6 is a side sectional view of FIG. 5.

FIGS. 5 and 6 illustrate the way to release the belt 80 from the buckle of the present invention. First, the push button 50 is depressed to move the push plate 40 against the spring 60. At this point, the inclined guiding surface 42 of the at least one locating recess 41 on the push plate 40 engaging with the at least one projected rod 32 on the brake member 30 shall cause the brake member 30 to move backward against the spring 61, resulting in the disengagement of the pawls 31 from the stop teeth 22 on the ratchet wheel 20. That is, the ratchet wheel 20 is now allowed to rotate in two directions and the belt 80 can be freely pushed further or pulled backward relative to the main body 10 as desired. And, when the push button 50 is released, the ratchet wheel 20 is immediately limited to rotate in only one direction the same as the moving direction of the belt 80.

The buckle of the present invention can be conveniently assembled from its components without using any rivet. The brake member 30 and the ratchet wheel 20 cooperate with one another for the belt 80 to be located at a desired point in a more reliable manner. And, any replacement of the components of the buckle can be easily done simply by loosening the screws 73 from the back cover 70.

What is claimed is:

1. A belt buckle comprising:

a main body having a belt end fixing means provided at one end of said main body for holding an end of a belt, a passage formed behind a front surface of said main body for another end of said belt to thread through, and a chamber for receiving other components of said buckle therein;

a ratchet wheel including a plurality of stop teeth around two side portions and a plurality of pressing teeth around a middle portion of said ratchet wheel;

a brake member being mounted in said chamber of said main body;

a push plate being transversely mounted to one surface of said brake member and being pushed by a first spring toward a top wall of said chamber;

a push button being mounted in a slot formed on a said top wall of said chamber; and a back cover being provided at an edge with an inward extended first stop plate and at two corners with threaded holes for screws to thread through and fix said back cover to said main body.

2. A belt buckle as claimed in claim 1, wherein said chamber of said main body is formed behind said passage and is separated from said passage by a partition, and said slot formed on said top wall of said chamber is a through slot allowing said push button to extend into said chamber.

3. A belt buckle as claimed in claim 2, wherein said chamber has a through hole formed on one end of said partition opposite to said belt end fixing means.

4. A belt buckle as claimed in claim 3, wherein said ratchet wheel is rotatably mounted in said chamber of said main body behind said through hole on said partition by transversely extending two ends of a shaft of said ratchet wheel into said top wall and a bottom wall of said chamber, such that said pressing teeth around said ratchet wheel extend through said through hole and into said passage.

5. A belt buckle as claimed in claim 1, wherein said brake member is formed with two forward extended pawls to engage with said stop teeth around two sides of said ratchet wheel and at least one rod projecting from a rear surface of said brake member; a second spring being positioned between an end of said brake member opposite to said pawls and said chamber to normally press said brake member against said ratchet wheel, so that said pawls normally engage with said stop teeth to limit said ratchet wheel to rotate only in one direction.

6. A belt buckle as claimed in claim 5, wherein said push plate is provided at one edge with at least one locating recess corresponding to said at least one projected rod on said brake member, said at least one locating recess having one side forming an outward inclined guiding surface, whereby when said push plate is caused to move toward said first spring, said guiding surface of said at least one locating recess forces said brake member to move backward against said second spring and disengage from said ratchet wheel.

7. A belt buckle as claimed in claim 1, wherein said push button is provided at a rear low edge with a second stop plate which is always in contact with an end of said push plate opposite to said first spring, whereby when said push button is depressed, said second stop plate pushes said push plate to move against said first spring.

8. A belt buckle as claimed in claim 1, wherein said first stop plate on said back cover is located between said top wall of said chamber and said second stop plate on said push button when said back cover is closed to cover said chamber of said main body, stopping said push button from separating from said main body.

* * * * *